US008295128B2

(12) United States Patent
Hasumi et al.

(10) Patent No.: US 8,295,128 B2
(45) Date of Patent: Oct. 23, 2012

(54) RADIO-CONTROLLED TIMEPIECE

(75) Inventors: Takayuki Hasumi, Niiza (JP); Moto Yamashita, Hachiouji (JP)

(73) Assignee: Citizen Holdings Co., Ltd., Tokyo (JP)

( * ) Notice: Subject to any disclaimer, the term of this patent is extended or adjusted under 35 U.S.C. 154(b) by 521 days.

(21) Appl. No.: 12/448,910

(22) PCT Filed: Feb. 19, 2008

(86) PCT No.: PCT/JP2008/052712

§ 371 (c)(1),
(2), (4) Date: Jul. 15, 2009

(87) PCT Pub. No.: WO2008/102752

PCT Pub. Date: Aug. 28, 2008

(65) Prior Publication Data

US 2010/0074059 A1 Mar. 25, 2010

(30) Foreign Application Priority Data

Feb. 22, 2007 (JP) ..... 2007-041932

(51) Int. Cl.
*G04C 11/02* (2006.01)

(52) U.S. Cl. ..... 368/47; 368/66; 368/80

(58) Field of Classification Search ..... 368/47, 368/80

See application file for complete search history.

(56) References Cited

U.S. PATENT DOCUMENTS

| | | | | |
|---|---|---|---|---|
| 5,237,544 | A | 8/1993 | Sase et al. | |
| 5,446,702 | A | 8/1995 | Mossuz et al. | |
| 5,745,440 | A * | 4/1998 | Chen | 368/27 |
| 7,274,624 | B2 * | 9/2007 | Gueissaz | 368/204 |
| 2008/0094942 | A1 | 4/2008 | Oguchi et al. | |

FOREIGN PATENT DOCUMENTS

| | | |
|---|---|---|
| CH | 667 363 | 10/1988 |
| EP | 0 621 519 | 4/1994 |
| EP | 1 455 249 | 9/2004 |
| JP | 3-13885 | 1/1991 |
| JP | 4-7394 | 1/1992 |
| JP | 5-6393 | 1/1993 |
| JP | 8-201546 | 8/1996 |
| JP | 10-73673 | 3/1998 |
| JP | 2004-077491 | 3/2004 |
| JP | 2004-163439 | 6/2004 |
| JP | 2005-3675 | 1/2005 |
| JP | 2006-98073 | 4/2006 |
| JP | 2006-153651 | 6/2006 |
| JP | 2007-121076 | 5/2007 |
| JP | 2007-132822 | 5/2007 |

OTHER PUBLICATIONS

International Search Report issued Mar. 18, 2008 in the International (PCT) Application of which the present application is the U.S. National Stage.

Supplementary European Search Report issued Apr. 27, 2010 in EP 08 71 1536.

Japanese Office Action issued Jan. 20, 2012 in corresponding Japanese Application No. 2009-500182.

* cited by examiner

*Primary Examiner* — Edwin A. Leon
*Assistant Examiner* — Jason Collins
(74) *Attorney, Agent, or Firm* — Wenderoth, Lnd & Ponack, L.L.P.

(57) ABSTRACT

A radio-controlled timepiece includes an antenna receiving a standard radio wave and a plurality of motors driving indicator portions which indicate information. A fourth motor which is driven at a lowest frequency during the standard radio wave reception of the antenna is disposed closer to the antenna than the rest of the motors.

8 Claims, 13 Drawing Sheets

(a)

(b)

(a)

(b)

(a)

(b)

RADIO-CONTROLLED TIMEPIECE

TECHNICAL FIELD

The present invention relates to a radio-controlled timepiece, and in particular, it relates to an improvement in a radio-controlled timepiece with a plurality of motors.

BACKGROUND ART

In recent years, so-called radio-controlled timepieces which receive a standard radio wave to automatically correct time have been widespread. (Patent Document 1). Recent timepiece models have improved appearance because an antenna for receiving the standard radio wave is now contained in a housing of a timepiece body, and resin-made housings have been replaced by metal-made housings due to improved reception performance of the radio wave. Furthermore, the radio-controlled timepiece has been used as a small size timepiece suitable for a female user.

Patent Document 1: Japanese Unexamined Patent Application Publication No. Hei 8-201546

The radio-controlled timepiece incorporates motors which forcibly change indication with an hour hand and the like to correct time. There is a problem in the motors that while they are driving, electric or magnetic signals for driving the motors may vary and the variance of the signals cause noise signals which may enter the standard radio wave and be received by the antenna. Receipt of the noise signals may lower the antenna's reception accuracy or detection accuracy of the standard radio wave as an original reception target. This may make it difficult to reproduce time information held in the standard radio wave at a desirable accuracy and exert unpredictable effects on the automatic correct function for the hands.

The radio timepiece also generally comprises a plurality of motors independently for an hour hand and for minute and second hands. In recent years, the timepiece has come to offer a large number of functions, and a timepiece with an LCD for indication of various types of information in addition to the motors has been popular. However, the radio-controlled timepiece is susceptible to noises from an internal noise source such as a motor or an LCD.

In view of solving the above problem, the present invention aims to provide a radio-controlled timepiece which can reduce an influence from a noise signal occurring inside the timepiece.

SUMMARY OF THE INVENTION

The present invention intends to achieve a radio-controlled timepiece which is unsusceptible to noise signals, by disposing one of a plurality of motors having a lower drive frequency than the other motors to be closest to the antenna, and preventing the antenna from being affected by the noise signals from driving motors.

A radio-controlled timepiece according to the present invention comprises an antenna receiving a standard radio wave, and a plurality of motors driving indicator portions which indicate information. Among the plurality of motors, a motor driven at the lowest frequency while the antenna is receiving the standard radio wave is disposed at a position closer to the antenna than the other motors.

With the thus-configured radio-controlled timepiece according to the present invention, the motor closest to the antenna is one generating a noise signal at a lowest frequency among the plurality of motors. This makes it possible to reduce, to a lowest level, an influence from noise signals from the motors on the antenna's reception of the standard radio wave.

That is, the motors generate noise signals every time they are driven so that one with the lowest drive frequency generates a noise signal at a lower frequency than the other motors. Accordingly, the antenna can be unsusceptible to noise signals from the closest motor since the closest motor is the one generating a noise signal at the lowest frequency.

Note that the information indicated by the above indicator portions is, for example, calendar information such as time information, date information, day information, or month information, remaining amount information of a battery (secondary battery) or a primary battery (button-type battery or the like), or information on city (country, region) names in a radio-controlled timepiece with a world time display function.

As a result, the radio-controlled timepiece according to the present invention can reduce an influence due to noise signals occurring inside the timepiece.

DESCRIPTION OF REFERENCE NUMERALS

81, 82, 83, 84 motor
91 antenna
100 radio-controlled timepiece

DETAILED DESCRIPTION OF THE INVENTION

Hereinafter, a radio-controlled timepiece according to embodiments of the present invention will be described in detail with reference to the accompanying drawings.

Figure 1:
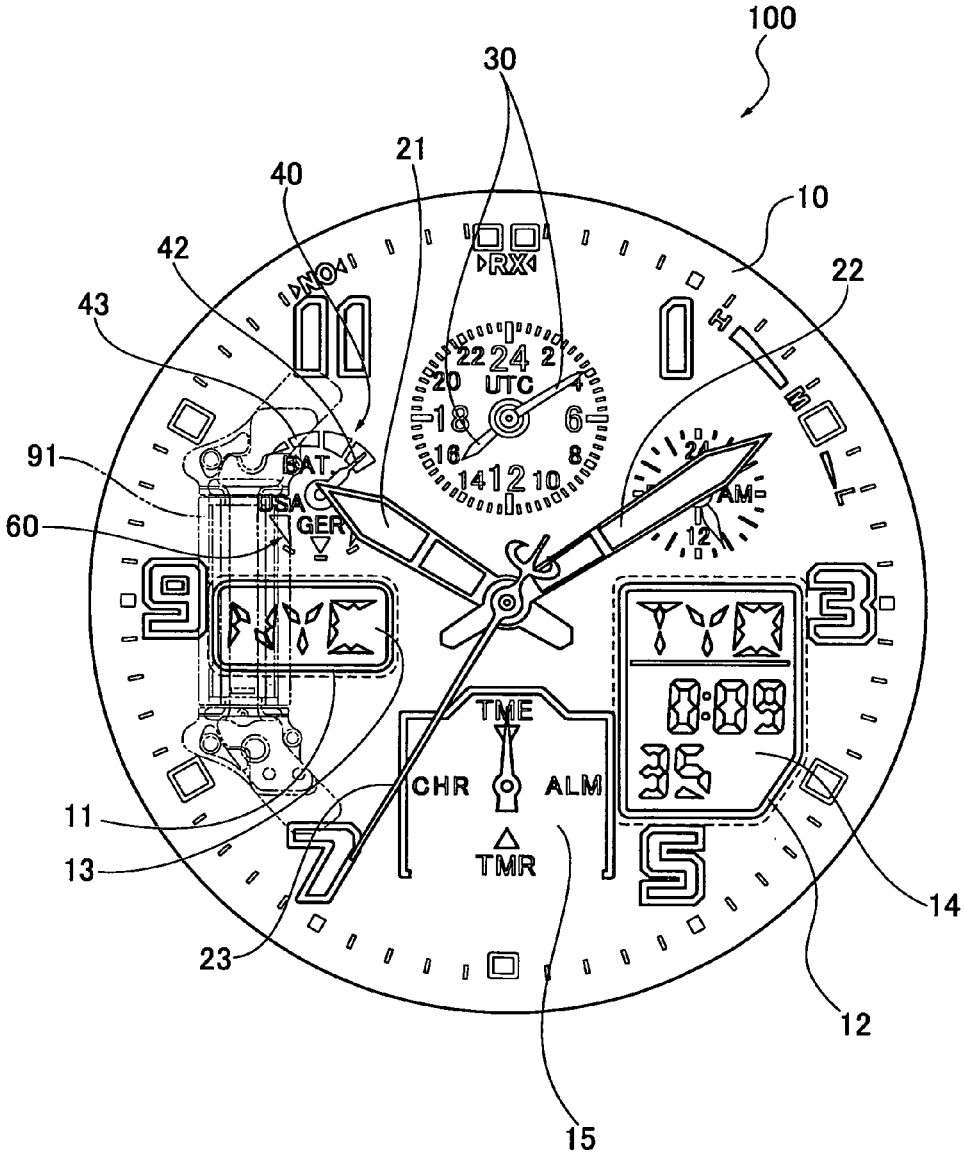
FIG. 1 shows the outer appearance of major parts of a radio-controlled timepiece according to one embodiment of the present invention.

FIG. 1 schematically shows the appearance of a radio-controlled timepiece 100 according to one embodiment of the present invention with a transparent antenna 91 in a region of a dial plate 10.

Figure 2:
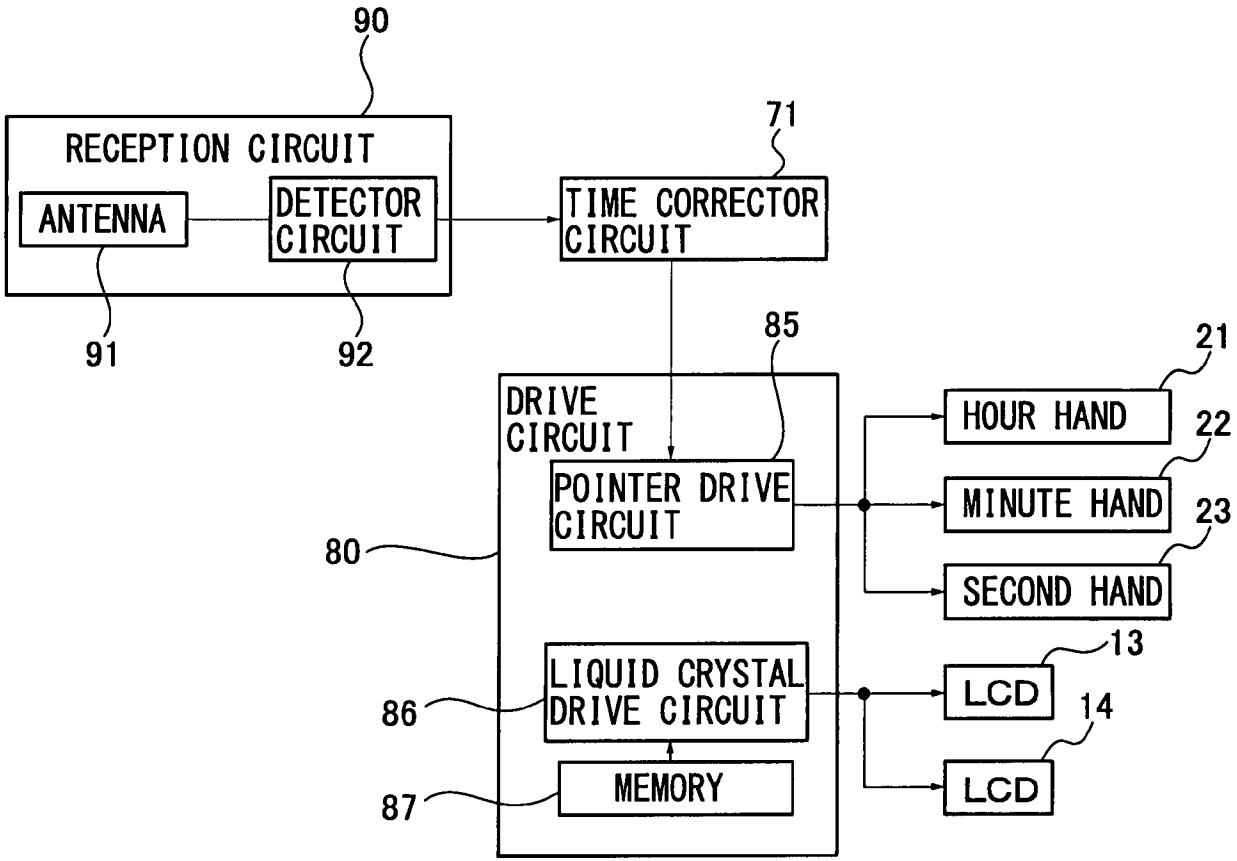
FIG. 2 is a block diagram of a structure of the radio-controlled timepiece in FIG. 1 which performs standard radio wave reception and time correction.

The radio-controlled timepiece 100 shown in the drawing comprises a reception circuit 90 and a time corrector circuit 71 to realize a standard radio wave receiving function (specific function), as shown in FIG. 2. The reception circuit 90 includes an antenna 91 which receives the standard radio wave at a predetermined time (generally, in midnight hours) to acquire standard time data, and a detector circuit 92. The time corrector circuit 71 generates time data according to a signal relative to the standard radio wave acquired by the reception circuit 90 and allows a drive circuit 80 to automatically move, based on the generated time data, an hour hand 21, a minute hand 22, and a second hand 23 as analog pointers of the timepiece 100 for time correction.

The drive circuit 80 comprises motors 81, 82 to drive the hour hand 21, and the minute hand 22 and second hand 23, respectively, and motors 83, 84 to drive later-described UTC hands 30 and a charge amount indicator 40, respectively, a pointer drive circuit 85 to control driving of the motors 81 to 84, a liquid crystal drive circuit 86 to drive LCDs 13, 14 based on time difference information and a mode mark shading pattern stored in a memory 87.

Figure 3:
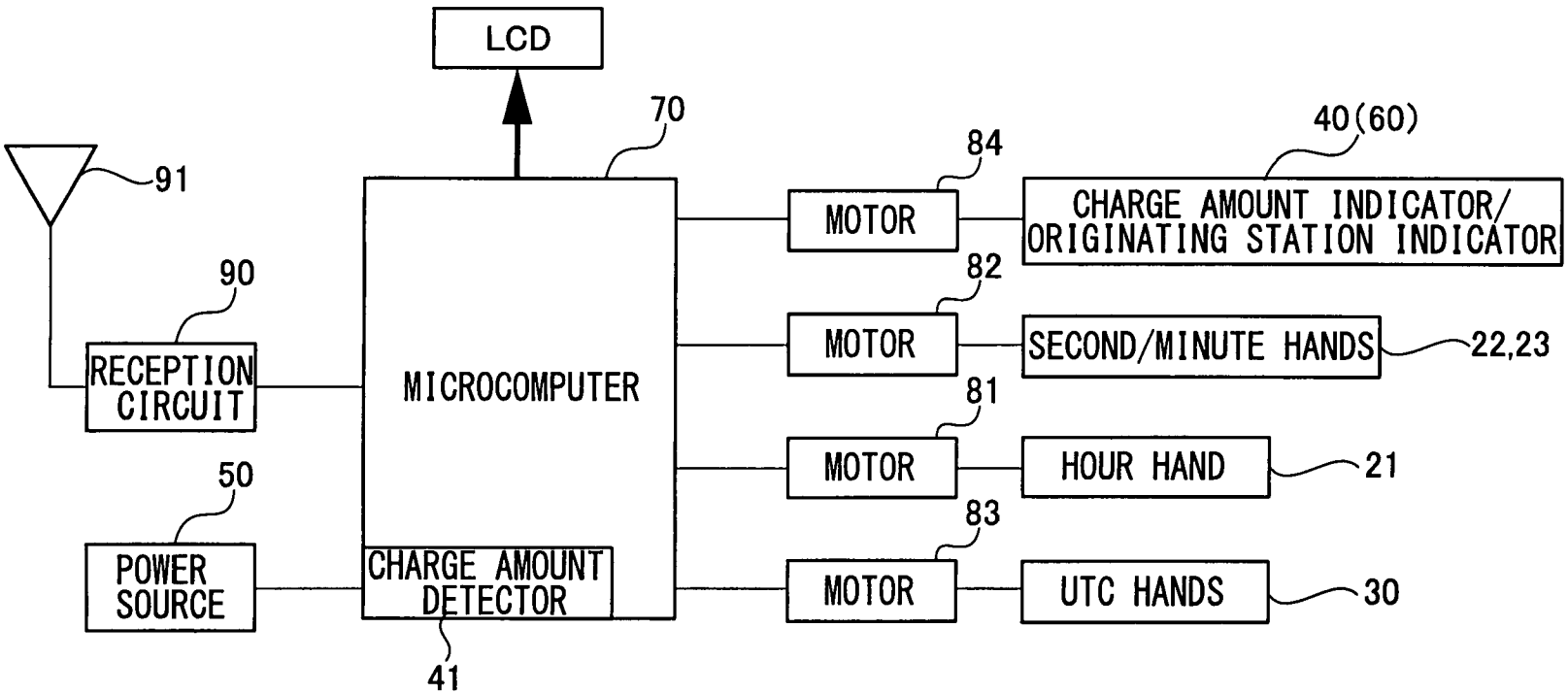
FIG. 3 is a block diagram showing details of the structure in FIG. 2.

Further, the main units of the drive circuit 80 excluding the motors 81 to 84 and a predetermined decelerating gear train are incorporated in a microcomputer 70 as shown in FIG. 3.

Among the four motors 81 to 84, the first motor 81 drives the hour hand 21 as an analog pointer of the timepiece 100 while the second motor 82 drives the minute hand 22 and second hand 23.

The third motor 83 drives the UTC hands 30 to indicate coordinated universal time (hereinafter, UTC) on a 24-hour clock (making one rotation in 24 hours) which is disposed in the upper region of the dial plate 10 (near 0 o'clock representation).

The timepiece 100 also comprises a charge amount detector 41 (remaining amount detector) which detects a charge amount (remaining amount) of a power source (drive batteries as a rechargeable battery), and a charge amount indicator 40 (remaining amount indicator) which analog-indicates the charge amount detected by the charge amount detector 41 with a graphic display 43 and a pointer 42 (analog indicator) on the dial plate 10.

The last one of the four motors 81 to 84, the fourth motor 84 functions as a drive motor for the charge amount indicator (remaining amount indicator drive motor) which drives the pointer 42 of the charge amount indicator 40.

The analog indicator is not limited to the pointer 42, and another type of analog indicator such as a plate member (partially colored or designed member such as moon phase lunar age representation) is usable except a digital indicator indicating digitally changing designs of numbers or batteries or the like.

The fourth motor 84 as the drive motor for the charge amount indicator can be any motor which rotationally or linearly moves the pointer 42 or a plate member.

The present embodiment adopts the power source 50 as a battery, for example. However, the power source 50 can be a rechargeable battery (secondary battery) charged with electric power generated by solar panels or the like, or a replaceable battery (button-type battery or the like).

The charge amount (remaining amount) is an index which represents available capacity of electric power necessary for driving the motors 81 to 84. It should not be limited to direct physical quantity such as voltage, and it can be literal remaining amount or an amount already used. Indication of the used amount allows a user to roughly know the remaining amount.

Further, the timepiece 100 comprises an originating station indicator 60 which includes an analog indicator to indicate marks, "JPN", "GER", "USA" in association with a selected originating station from plural originating stations (for example, Japan (JPN), Germany (GER), the United States of America (USA)), and an originating station indicator drive motor driving the originating station indicator 60. The plural originating stations transmit standard radio waves containing different pieces of time information to different regions from each other.

In FIG. 1 and others, although the marks "JPN", "GER", "USA" are shown on the originating station indicator 60, the mark, "JPN" cannot be seen since it is disposed diagonally upward right from the mark "GER" but covered with the hour hand 21.

In the present embodiment, the pointer 42 of the charge amount indicator 40 is configured to double as the analog indicator of the originating station indicator 60 while the fourth motor 84 as a charge amount indicator drive motor is configured to double as the originating station indicator drive motor.

In FIG. 1, the charge amount indicator 40 is set in about the upper half region of the entire angular range (360 degrees) in which the pointer 42 is rotated, and the originating station indicator 60 is set in about the lower half region thereof.

Thus, the pointer 42 indicates a charge amount, pointing the charge amount indicator 40 in the upper half region while it indicates an originating station, pointing the originating station indicator 60 in the lower half region.

The single pointer 42 is driven by the fourth motor 84 and the indications of the charge amount in the charge amount indicator 40 and the originating station in the originating station indicator 60 can be alternatively switched under the control of the drive circuit 80 of the microcomputer 70.

The switch of indications can be arbitrarily set by a user's selection, or set in such a predetermined manner that the charge amount is indicated during non-reception period of the standard radio wave and the originating station is indicated during periods immediately before and immediately after the reception of the standard radio wave (or in the morning hours only or the like).

The marks representing the originating stations are not limited to the above three-letter abbreviations of the country names and can be arbitrary. Text, codes, pictures, and color-coding, or a combination of these are applicable as long as they are made different from each other and each of them can represent a single specific originating station.

Also, the marks representing the originating stations can be region names or city names where originating stations are located in addition to country names.

Further, in the present embodiment, drive frequency of each of the four motors 81 to 84 depends on a relation with an indicator it drives. The fourth motor 84 is lowest in drive frequency and the third motor 83, the first motor 81, and the second motor 82 follow in this order.

The indication of the charge amount by the pointer 42 remains unchanged during a very short period (about 1 to 5 minutes) when the antenna 91 is receiving the standard radio wave since a change in the charge amount of the power source 50 is extremely small.

That is, unlike digital display means such as LCD (liquid crystal display), the fourth motor 84 driving the pointer 42 can be stopped driving when the pointer 42 continuously points at a certain position with no change in the indication. Accordingly, there is no change in the driving signal for the fourth motor 84, generating no noise signal.

Thus, it can be said that there is almost no possibility for the fourth motor 84 to be driven during a short period when the antenna 91 is receiving the standard radio wave. This makes it possible to reduce generation of the noise signal from the fourth motor 84 to almost nothing.

In comparison with a known digital LCD used for the charge amount display which requires continuous generation of the drive signal at a predetermined frequency to continue the display irrespective of a change or no change in the display, the analog type radio-controlled timepiece with the pointer 42 and the fourth motor 84 according to the present embodiment is advantageous in reducing the frequency at which the noise signal occurs. Also, it can further prevent the noise signal from entering the antenna 91.

Moreover, the reduction in the influence of the noise signal makes it possible to eliminate or avoid limitation (being unable to be disposed close to the antenna 91 or limitation to a space for incorporating the LCD) to positioning of the charge amount indicator 40 in the prior art.

When the originating station is indicated by the originating station indicator 60 instead of the charge amount by the charge amount indicator 40 under the control of the drive circuit 80 of the microcomputer 70, the originating station is arbitrarily selected by a user. In other words, unless the user manipulates to change it during the reception of the standard radio wave by the antenna 91, the indication of the originating station is unchanged. Accordingly, during indication of the originating station, there is almost no possibility for the fourth motor 84 to be driven during a very short period when the antenna 91 is receiving the standard radio wave.

As described above, in both of the indications (charge amount or originating station), there is almost no possibility for the fourth motor 84 to be driven during a very short period when the antenna 91 is receiving the standard radio wave. The drive frequency of the fourth motor 84 is lower than that of the first to third motors 81 to 83. The second motor 82 needs to drive the second hand 23 at 60 steps per minute, the third motor 83 needs to drive the UTC hands 30 at 1 step per 15 seconds, and the first motor 21 needs to drive the hour hand 21 at 1 step per 2 minutes.

Figure 4:
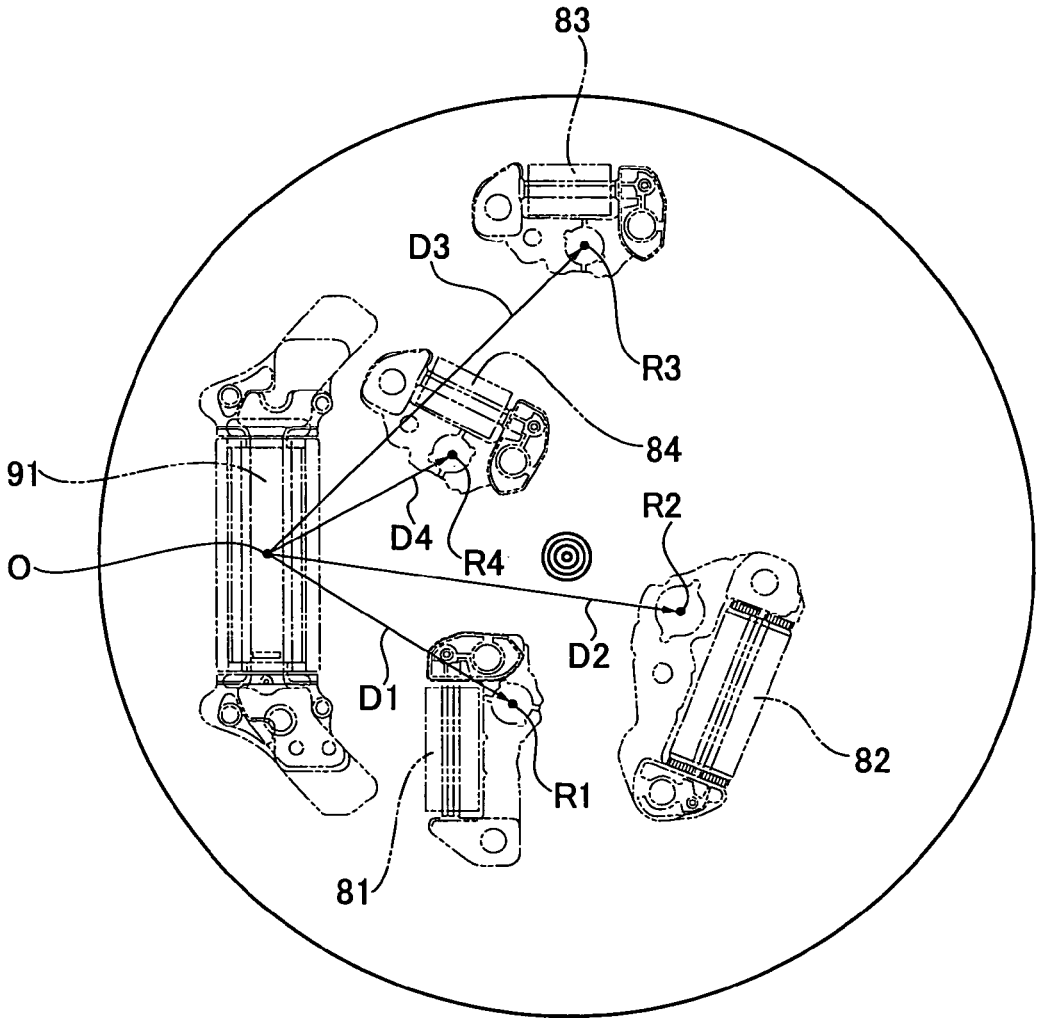
FIG. 4 schematically shows a positional relation between four motors and an antenna incorporated in the radio-controlled timepiece of FIG. 1.

FIG. 4 shows the arrangement of the antenna 91 and the respective motors 81 to 84 which is the same as that in FIG. 1.

Distances D1, D2, D3, D4 between the center O of the antenna in longitudinal direction and the centers R1, R2, R3, R4 of rotors of the motors 81 to 84 are determined to satisfy D4<D1<D3<D2.

Thus, the fourth motor 84 driven at the lowest frequency during the standard radio wave reception of the antenna 91 is disposed closer to the antenna 91 than the rest of the motors 81 to 83.

Noise signals (undesired signals, signals other than the standard radio wave to be received by the antenna 91) occur from the motors 81 to 84 during driving. Therefore, the fourth motor 84 with the lowest drive frequency among the four motors 81 to 84 generates a noise signal at a lower frequency than the other motors 81 to 83. There is less possibility for a noise signal from the fourth motor 84 to enter the antenna 91 (reception circuit 90) during reception of the standard radio wave than from the other motors 81 to 83.

Meanwhile, the reception performance of the antenna 91 depends on a distance Di (i=1, 2, 3, 4) to a source of signals (general signals, not only noise signals) so that the antenna 91 is most affected by the fourth motor 84 with a closest distance Di thereto among the four motors 81 to 84.

According to the radio-controlled timepiece 100 in the present embodiment, the fourth motor 84 at the position D4 closest to the antenna 91 is the one to least generate the noise signal among the four motors 81 to 84. Therefore, the noise signal therefrom affects the reception of the standard radio wave at the antenna 91 less than those from the other motors 81 to 83.

In addition, the four motors 81 to 84 are arranged relative to the antenna 91 in the order of magnitude of the drive frequency (the fourth motor 84<the first motor 81<the third motor 83<the second motor 82) during the standard radio wave reception, such that the higher the drive frequency, the further the distance Di (i=1 to 4) from the antenna 91 (D4<D1<D3<D2). The high/low (magnitude) of the drive frequency is associated with the far/near (magnitude) of the distance Di so that it is able to maximally reduce an influence from the noise signals from the motor 81 to 83 other than the motor 84 closest to the antenna 91.

Furthermore, owing to the extremely low drive frequency of the fourth motor 84, driving of the fourth motor 84 can be stopped, reducing power consumption thereof.

Further, the timepiece 100 according to the present embodiment can be configured so that the fourth motor 84 drives a calendar indicator indicating a calendar (almanac) as dates or days in replace of the charge amount indicator 40 (and/or originating station indicator 60) analog-indicating the charge amount of the power source 50.

Figure 5:
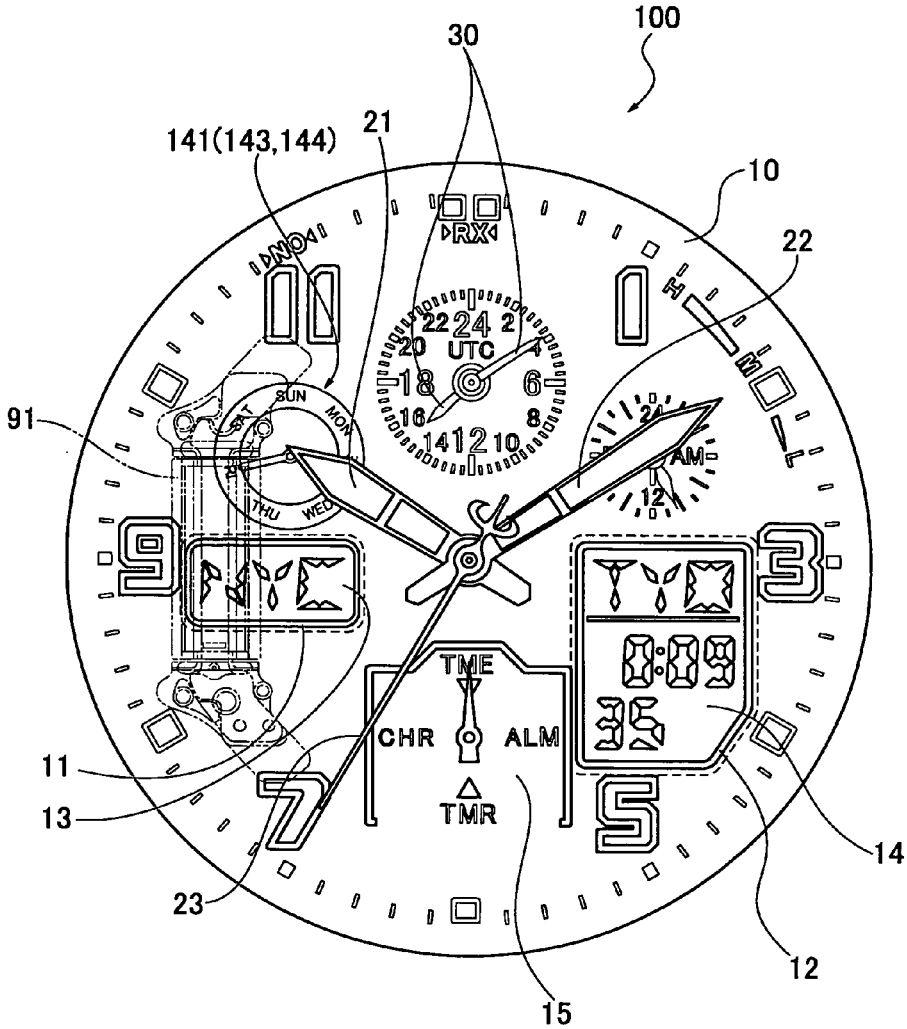
FIG. 5(*a*) is a plain transparent view of details of the radio-controlled timepiece in FIG. 1 including a calendar indicator instead of a charge amount indicator, and FIG. 5(*b*) shows details of a day indicator as the calendar indicator.
Figure 5:
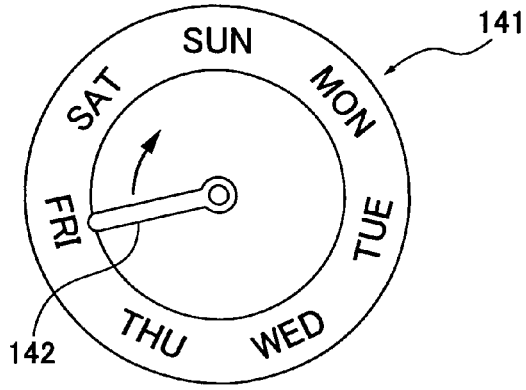

For example, the timepiece 100 can include a day indicator 141 shown in FIG. 5(*a*) as a calendar indicator. The day indicator 141 sequentially indicates days of the week and is in a circular form on the dial plate 10. Along the periphery of the circular form, character strings, "SUN", "MON", "TUE", "WED", "THU", "FRI", "SAT" representing 7 days (Sunday, Monday, Wednesday, Thursday, Friday, Saturday) are written or formed, as shown in detail in FIG. 5(*b*). A pointer 142 is rotated around the center of the circular form in one direction (clockwise) to indicate one of the character strings, "SUN", "MON", "TUE", "WED", "THU", "FRI", "SAT". The pointer 142 of the day indicator 141 is driven by the above fourth motor 84 as a day indicator drive motor (calendar indicator drive motor).

Each scale per day ("SUN", "MON", "TUE", "WED", "THU", "FRI", "SAT") of the pointer 142 of the day indicator 141 corresponds to each interval between the adjacent character strings. This one scale does not represent a single step (pulse) of the motor 84 necessary for moving the one scale. The possibility (frequency) at which the day indicator 141 is driven by the fourth motor 84 is extremely low. The drive frequency of each of the four motors 81 to 84 depends on the relation with the indicator it drives. The fourth motor 84 is lowest in drive frequency and the first motor 81, the third motor 83, and the second motor 82 follow in this order.

Accordingly, the frequency at which a noise occurs from the fourth motor 84 is once a day, and it is extremely low in comparison with that of the other three motors 81 to 83.

Further, the fourth motor 84 is disposed closer to the antenna 91 than the other motors 81 to 83. With such a configuration, it is made possible to reduce an influence from noise on the antenna 91 more than a configuration in which the other motors 81 to 83 are closer to the antenna 91.

Figure 6:
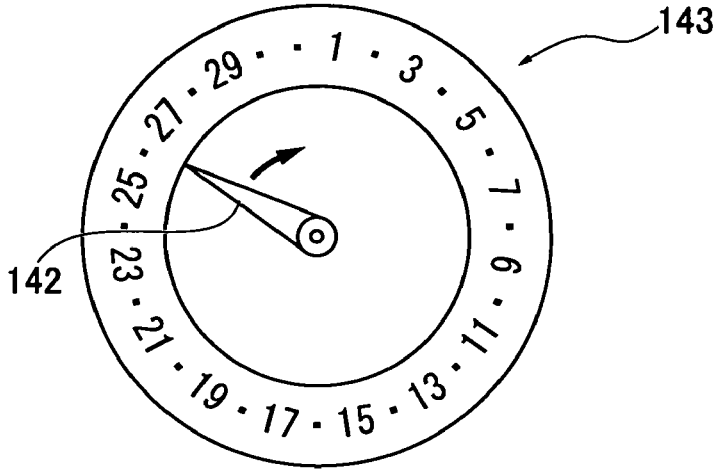
FIG. 6(*a*) shows a date indicator and FIG. 6(*b*) shows a month indicator as another example of the calendar indicator of the radio-controlled timepiece in FIG. 5.
Figure 6:
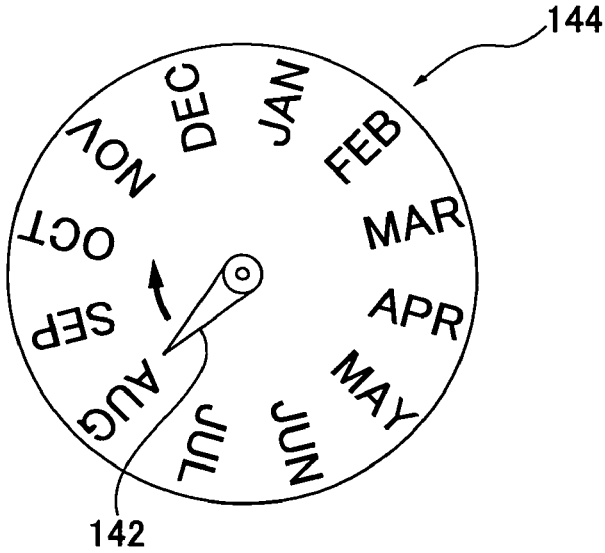

Note that the calendar indicator is not limited to the above day indicator 141. It can be a date indicator 143 with a pointer 142 sequentially indicating dates of the month (1, "•" (indicating omitted 2), 3 . . . 29, "•" (indicating omitted 30), "•" (indicating omitted 31)) as shown in FIG. 6(*a*). Alternatively, it can be a month indicator 144 with a pointer 142 sequentially indicating months of the year ("JAN", "FEB" . . . "DEC"). The radio-controlled timepiece 100 can be configured to include one or two or more of the calendar indicators 141, 143, 144 in replace of the charge amount indicator 40 (and/or originating station indicator 60). Further, such radio-controlled timepieces 100 including the respective calendar indicators 141, 143, 144 can also achieve the same functions and effects as timepiece 100 in the present embodiment.

The day indication (FIG. 5) or date indication (FIG. 6(*a*)) as calendar indication is generally updated once a day at 0:00 a.m. Therefore, it is possible to prevent adverse effects from the noise from the fourth motor 84 in operation on the regular reception of standard radio wave at the antenna 91 by presetting (by program in the microcomputer 70) the reception time (of regular reception) in a time zone other than the time at which the calendar indication is updated.

The month indication (FIG. 6(*b*)) is generally updated once a month. Therefore, it is possible to prevent adverse effects from the noise from the fourth motor 84 in operation on the regular reception of standard radio wave by the antenna 91 by presetting (by program in the microcomputer 70) the reception time (of regular reception) in a time zone other than the time at which the calendar indication is updated.

Thus, the time of the regular reception can be set at time excluding 0:00 a.m. for the calendar indication update such as at 2, 3, or 4 o'clock in the morning, for example.

Meanwhile, in addition to the regular reception, in a case where a user intends to receive the standard radio wave (enforced reception of the standard radio wave by a user's manipulation to operational members such as buttons), the time of the user's manipulation and the time of the update for calendar indication may accidentally coincide with each other.

In such a case, the user's intention is given priority. The enforced reception is performed while the update for calendar indication is temporarily stopped and the fourth motor 84 is stopped not to generate noise. After completion of the enforced reception (in about 10 minutes after the completion, preferably), the update for calendar indication can be executed. The order of such operation can be controlled by the program executed in the microcomputer 70.

Furthermore, as described later, the LCD 13 displays a city name (home city; NYC represents New York city) in association with the time indicated by the hour hand 21, minute hand 22, and second hand 23 as the analog pointer. There may be a case where a user moves to another city and operates (input or the like to a not-shown button or else) to change the display of the home city around local time 0:00 a.m, dates may be different before and after the change of the display. In such a case, the calendar indication is updated by the change of the home city display.

Moreover, the update for the calendar indication due to the change of the home city display may accidentally occur at the regular reception time. In this case, the update for the calendar indication performed concurrently with the change of the home city display is given priority, and the regular time reception is terminated until the completion of the calendar indication update. Because of this, it is possible to prevent the noise from the fourth motor 84 in operation from adversely affecting the regular reception of the standard radio wave at the antenna 91.

Slight delay of the regular reception may slightly delay the reception timing, but correction of time can be accurately done.

Figure 7:
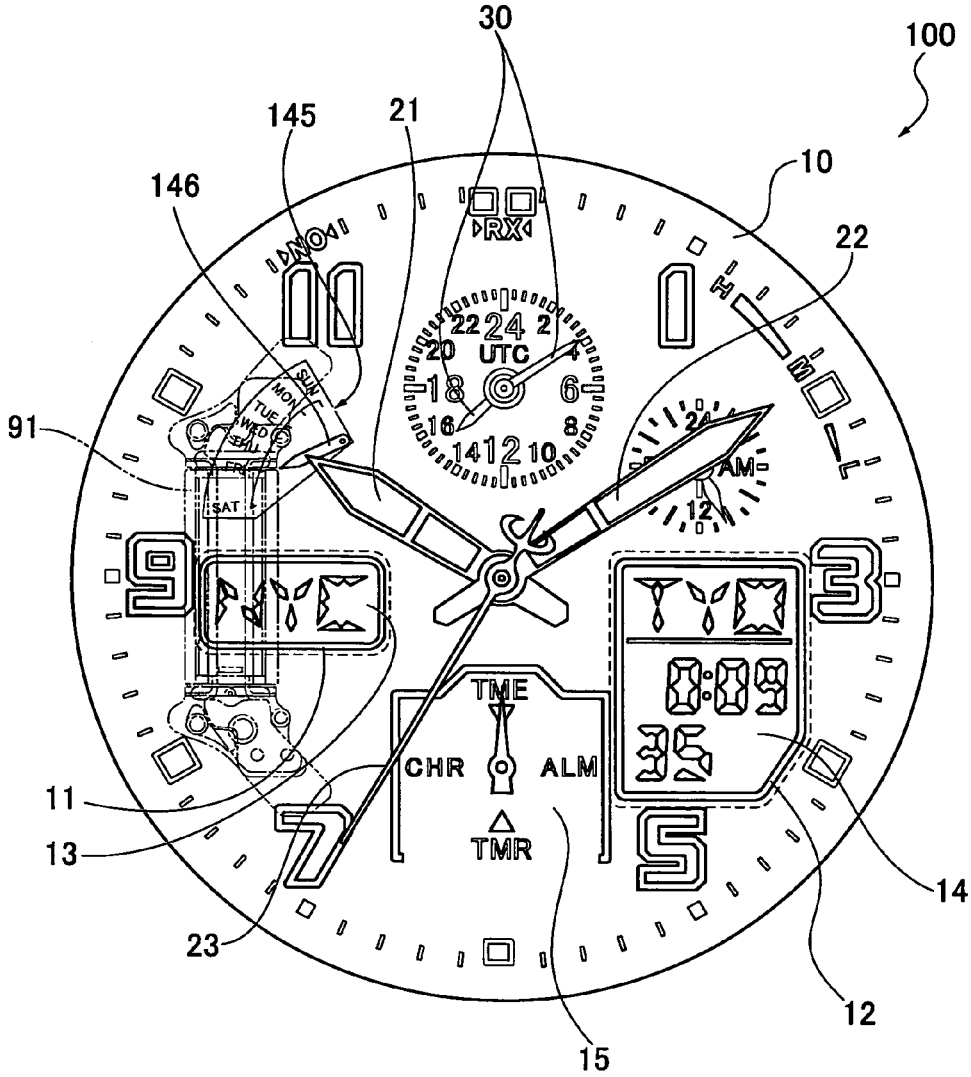
FIG. 7(*a*) is a plain transparent view of another example of the day indicator in FIG. 5, and FIG. 7(*b*) shows details of the day indicator.
Figure 7:
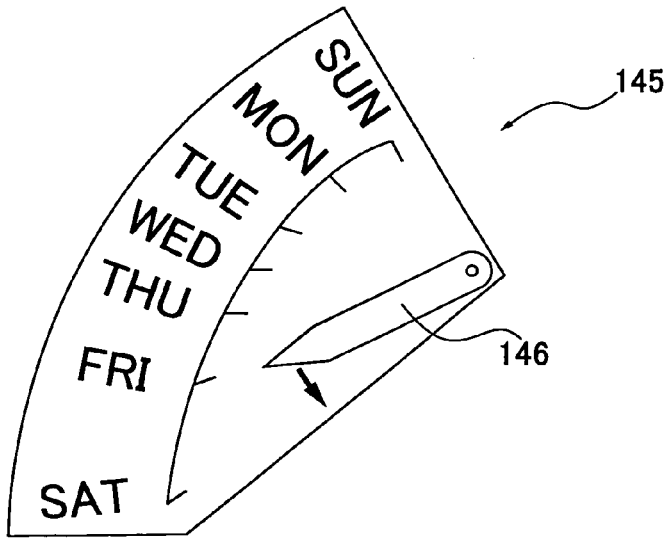

In addition to the above calendar indicator in circular form having the rotary pointer 142, one 145 shown in FIGS. 7(*a*), 7(*b*) can be used, which comprises a fan-shaped indication area and a pointer 146 able to reciprocate in an angle range of the fan shape, for example. The calendar indicator 145 in the fan shape can attain the same functions and effects as those of the calendar indicator 141 or the like in the circular form.

The calendar indication in the above embodiments (FIGS. 5 to 7) in which letters and numerals are pointed by the pointers 142, 146 can substantially reduce the number of generation steps of the motor for date changes, compared with one having a circular date plate of an outer diameter slightly smaller than that of the dial plate 10 which is rotated by a step motor for calendar indication of a general wrist watch. Accordingly, it can shorten a length of time in which noise is continuously generated so that it is more preferable to the calendar indication with the above date plate.

However, this does not mean that the radio-controlled timepiece according to the present invention cannot be configured with the above date plate of a large outer diameter. It can be configured that such a date plate is directly driven by the fourth motor 84 with the lowest drive frequency.

Figure 8:
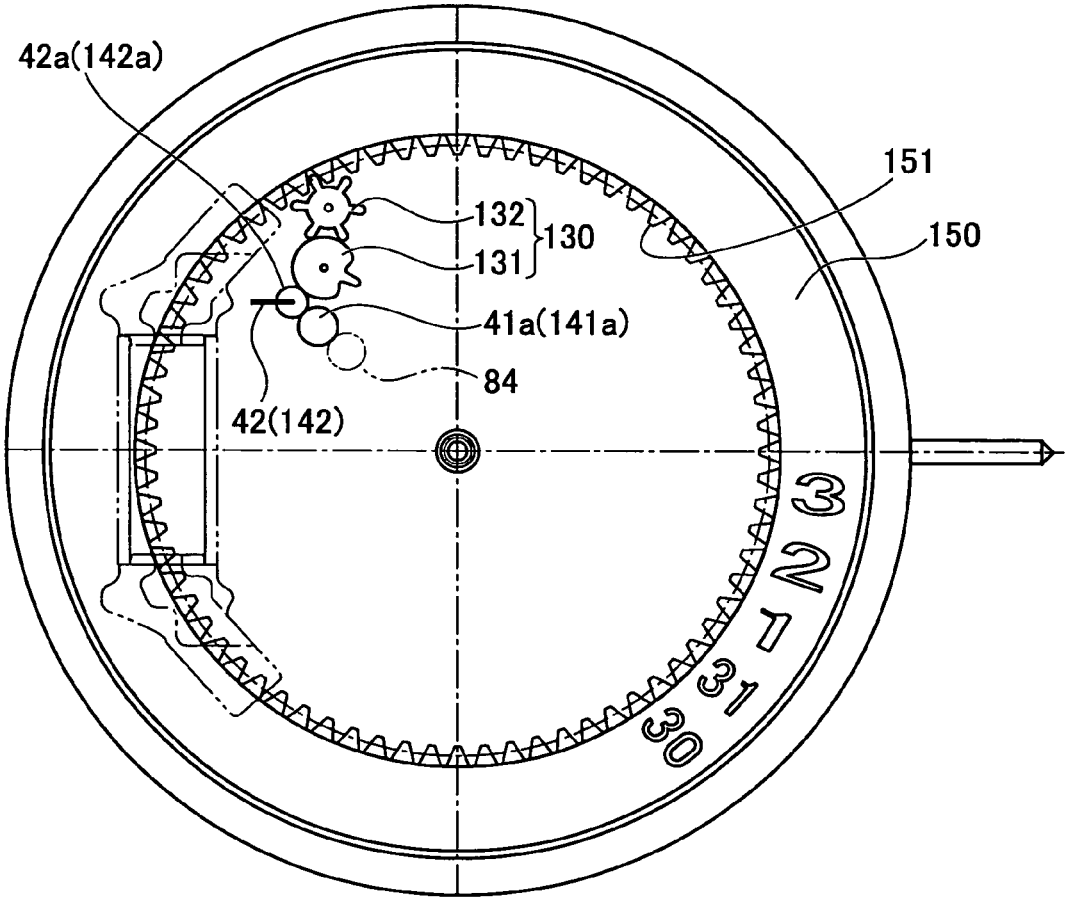
FIG. 8 is a view (plain transparent view) of the main parts of the radio-controlled timepiece according to the present embodiment which has a structure in which the charge amount indicator in FIG. 1, or the calendar indicator in FIG. 5 and a date plate for date indication are interlocked via a Geneva mechanism.

Further, according to the radio-controlled timepiece 100 in the embodiment shown in FIG. 1, the pointer 42 of the charge amount indicator 40 (and/or originating station indicator 60), the pointer 142 of the day indicator 141, or the pointers 142, 146 of the month indicators 144, 145 are fixed to wheels 42*a*, 142*a* (see FIG. 8). The rotation of the fourth motor 84 is transmitted via a train wheel 41*a* (or train wheel 141*a*) such as an intermediate wheel to the wheels 42*a*, 142*a*. Also, the rotation of the wheels 42*a*, 142*a* having the fixed pointer 42 (142, 146) can be transmitted to drive the above circular date plate 150 of a slightly smaller diameter than that of the dial plate 10. Thus, the single motor 84 can be used to indicate the charge amount (and/or originating station, or date or month) as well as to drive the date plate for date change, which can realize multiple functions with a small number of motors.

Furthermore, the gear of the wheel having the fixed pointer 42 (142, 146) can be connected with an inner gear 151 of the date plate 150 by a Geneva mechanism 130 similar to a known Geneva (Geneve) mechanism disclosed in Japanese Unexamined Patent Application Publication No. Hei 10-073673 (paragraphs [0011], [0012] and FIGS. 1, 4) for example. The Geneva mechanism 130 shown in FIG. 8 comprises a date indicator transmission wheel 131 which engages with the gear having the fixed pointer 42 (142, 146), and a date wheel 132 which rotates in coordination with the rotation of the date indicator transmission wheel 131 only in a certain angle range thereof and does not rotate outside the certain angle range, and engages with the inner gear 151 of the date plate 150.

Detailed description on structure and operation of the Geneva mechanism 130 is omitted. The date indicated by the date plate 150 is changed as the update for the calendar indication only at 0:00 a.m., for example, irrespective of the charge amount or originating station (or date or month) pointed by the pointer 42 (142). Under the control of the program of the microcomputer 70, rapid rotation of the motor 84 is transmitted to the pointer 42 (142) via the intermediate wheel 41*a* (141*a*) to rotate the pointer 42 (142). Then, the rotation of the pointer 42 (142) is transmitted to the date plate 150 via the Geneva mechanism 130 to change the date of the date plate 150 (update for the calendar indication).

The date indication is changed once a day so that the motor 84 can drive both the date plate and the pointer 42 of the charge amount indicator 40 (and/or originating station indicator 60) at a very low frequency. Therefore, it will not adversely affect the reception of the standard radio wave at the antenna 91.

Furthermore, among prior art radio-controlled timepieces, there is one configured to include a dial plate with a solar panel to generate electric power, a battery to charge the electric power, and an LCD digitally displaying the charge amount. For the purpose of reducing extraneous power consumption, such a radio-controlled timepiece automatically shifts into a power saving mode for turning off the LCD or the like under a dark environment in which light is not radiated to the solar panel.

However, a problem may arise from the turning-off of the LCD display in the power saving mode that a user cannot see a digital display of the charge amount on the LCD.

Unlike the above timepiece, the radio-controlled timepiece 100 analog-indicates the charge amount on the LCD instead of the digital display. Accordingly, even during the power saving mode to turn off the LCD, the user can visually check the charge amount of the power source 50. Also, it can adopt the power saving mode for turning off LCDs 13, 14 or else separately provided for other purposes.

This radio-controlled timepiece 100 includes two small opening windows 11, 12 on the dial plate 10. The LCD 13 is fitted into the small window 11 to digitally display a city name (referred to as home city; NYC (New York city) in FIG. 1) in association with time indicated by the hour hand 21, minute hand 22, and second hand 23 as analog pointers.

Here, the city name to display on the LCD 13 is chosen by a user's press to a city-name selector button (not shown) or the like on a side portion of the timepiece 100.

The LCD 14 is fitted into the other small window 12 of the dial plate 10 to digitally display world time, measured time by chronogram, set alarm time or the like.

In FIG. 1, the LCD 14 digitally displays a character string, TYO as a city name (Tokyo) and present time 0:09:35 a.m. in Tokyo. The city name is chosen from plural cities preset for world time display by a world time setting function.

The item to display on the LCD 13 is chosen by a user's press to a mode selector button (not shown) or the like on a side portion of the timepiece 100.

Modes to select are a time display function TME to display a current time, a chronogram function CHR to display an elapsed time, a timer function TMR to display a remaining amount of time to a predetermined time, and an alarm function ALM to set/display an alarm time.

The world time setting function to select a city for world time display can be included in the time display function TME to display a current time. Alternatively, it can be activated by a manipulation to another button or else on the housing of the timepiece 100.

The radio-controlled timepiece 100 according to the present embodiment includes the above four functions. However, it is not limited thereto, and it may or may not have a different kind of function.

Figure 9:
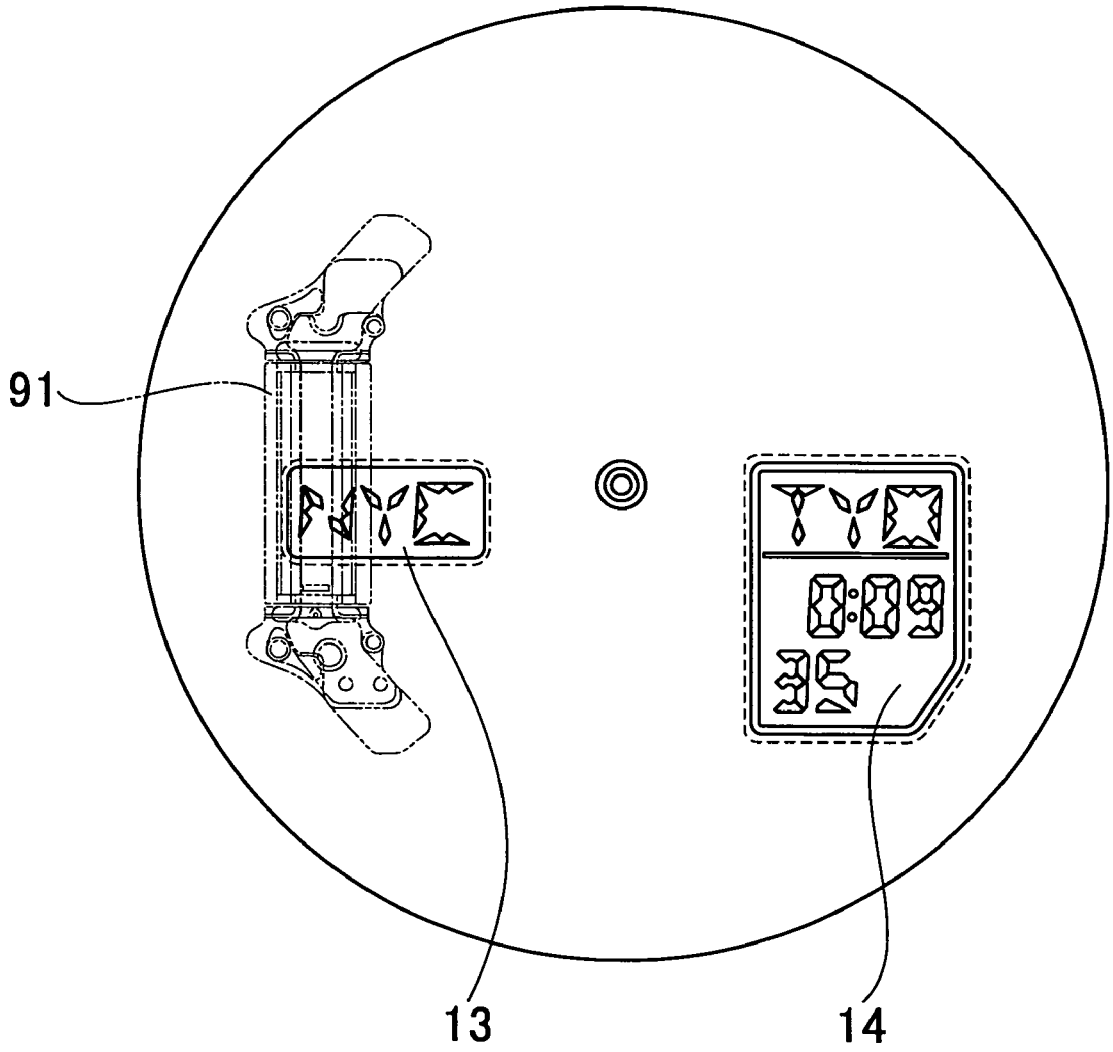
FIG. 9 schematically shows a positional relation between two LDCs and an antenna in the radio-controlled timepiece in FIG. 1.

Moreover, the radio-controlled timepiece 100 according to the present embodiment is of an analog-digital combination type which includes the two (plural) LCDs 13, 14 (digital display means) to drive indicators to digitally indicate information. As schematically shown in FIG. 9, between the two LCDs 13, 14, the LCD 13 of a smaller size is disposed nearer to the antenna 91 than the other LCD 14.

The LCDs 13, 14 may generate noise signals as the driven motors 81 to 84 do. The noise signal may enter the standard radio wave and be received by the antenna 91 of the radio-controlled timepiece 100.

The reception of the noise signals by the antenna 91 may result in lowering reception accuracy or detection accuracy of the standard radio wave as an original reception target. This may make it difficult to reproduce time information held in the standard radio wave at a desirable accuracy, and exert an unpredictable effect on the automatic correct function for the hour hand 21, minute hand 22, and second hand 23.

However, in the radio-controlled timepiece 100 according to the present embodiment, between the plural LCDs 13, 14 as a source of noise, the LCD 13 is disposed closer to the antenna 91, and generates a noise signal with a smaller level. Therefore, it is possible to reduce, to a lowest level, an influence from the noise signal of the LCDs 13, 14 on the reception of the standard radio wave by the antenna 91.

It is obvious that the larger the display size of the LCD, the larger the level of the generated noise signal. The noise signal generated from the LCD 13 smaller in display size than the LCD 14 is smaller in level than that from the LCD 14.

Further, as shown in FIGS. 1, 5, 7, 9, the LCD 13 smaller in display size is disposed to at least partially planarly overlap with the antenna 91 in a direction of thickness of the timepiece 100. This enables reduction of the entire face size of the timepiece 100 and downsizing of the whole timepiece 100.

Moreover, positions of the two LCDs 13, 14 are determined according to their display sizes such that the larger the display size, the further the distance Di from the antenna 91. Accordingly, it is possible to maximally reduce an influence from the noise signal of the LCD 14 other than the LCD 13 closest to the antenna 91 on the reception of the standard radio wave by the antenna 91.

In the radio-controlled timepiece 100 according to the present embodiment, the LCD 13 displays NYC (New York city) as a home city. However, it can display other city names than NYC, or UTC (Universal Time Coordinated) instead of a specific city name. In this case, the UTC is concurrently shown in two kinds of representation, in 24 hours by the UTC hands 30 and in 12 hours by the hour hand 21, minute hand 22, and second hand 23.

Here, in a case where a user has intentionally selected UTC instead of London (LON; no time difference from UTC) as a home city, he or she is considered to be in a situation requiring UTC such as a pilot's maneuvering airplane.

The timepiece of a pilot is required to always show time accurately during his/her maneuvering of an airplane.

However, since the operation of the hour hand 21, minute hand 22, and second hand 23 is terminated during reception of the standard radio wave (in order to receive the standard radio wave accurately) for a few minutes, time indicated by the hour hand 21, minute hand 22, and second hand 23 in the home city (UTC) cannot be accurate for that period.

In view of solving the above problem, the radio-controlled timepiece 100 according to the present embodiment is configured that the microcomputer 70 (time corrector circuit 71) allows the reception circuit 90 to stop the reception of the standard radio wave when UTC is displayed as a home city on the LCD 13. Thus, stoppage of the standard radio wave reception when the home city is UTC makes it possible to avoid temporary, inaccurate indication of time in the home city due to the standard radio wave reception.

MODIFIED EXAMPLE 1

Figure 10:
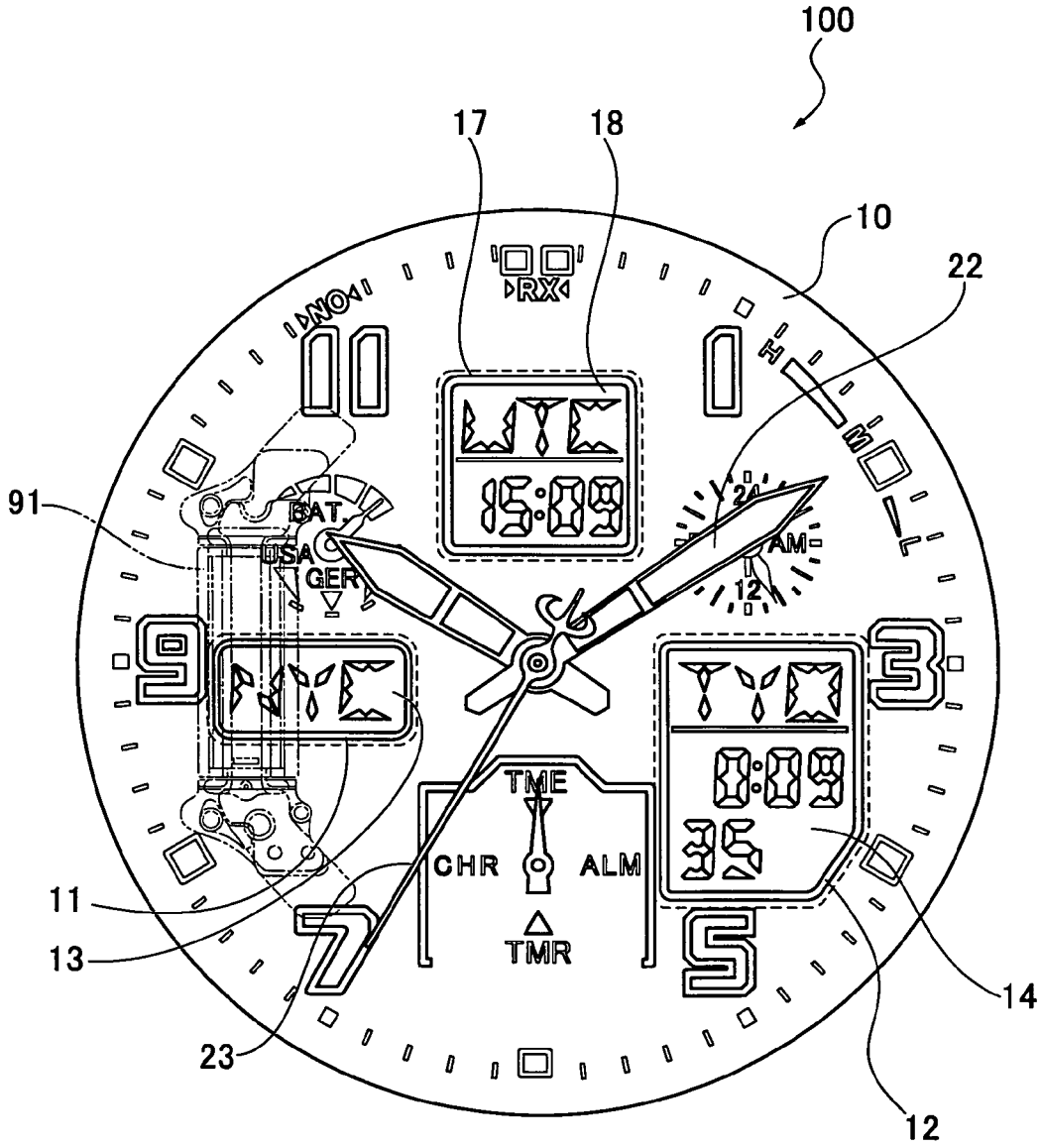
FIG. 10 shows a positional relation between three LCDs for digital indication of UTC and the antenna.

The radio-controlled timepiece 100 according to the present embodiment shown in FIG. 1 and else analog-indicates the UTC with the UTC hands 30. However, the radio-controlled timepiece according to the present invention is not limited to this type. It can be configured not to show the UTC. Or, it can be configured to include a small window 17 in the dial plate 10 as the LCDs 13, 14, and have an LCD 18 fitted into the small window 17 to digitally display the UTC, which is shown in FIG. 10 as a modified example of the embodiment.

Regarding the display size of the LCDs 13, 18, 14, the LCD 13 is smallest, the LCD 18 is larger than the LCD 13 and smaller than the LCD 14, and the LCD 14 is largest.

Further, relative to the antenna 91, a distance from the LCD 18 is set to be longer than that from LCD 13 and shorter than that from the LCD 14.

That is, the three LCDs 13, 18, 14 are disposed in order of their display size such that the larger the display size, the further the distance from the antenna 91.

According to such a modified example 1, magnitude of the display sizes of the LCD 13, 18, 14 is associated with their distances (short/long) from the antenna 91. This makes it possible to maximally reduce an influence from the noise signals from the LCDs 18, 14 other than the LCD 13 closest to the antenna 91 onto the reception performance of the antenna 91.

In the radio-controlled timepiece according to the present invention, the indicators are not required to be independent LCDs as in the above embodiment (including the two LCDs 13, 14 in the modified example 1 or three or more LCDs in another embodiment). That is, provision of one LCD should be incorporated in the technical scope of the radio-controlled timepiece according to the present invention as long as a plurality of indicators including this LCD and an analog indicator (driven by a motor) are provided and driven actually.

MODIFIED EXAMPLE 2

Figure 11:
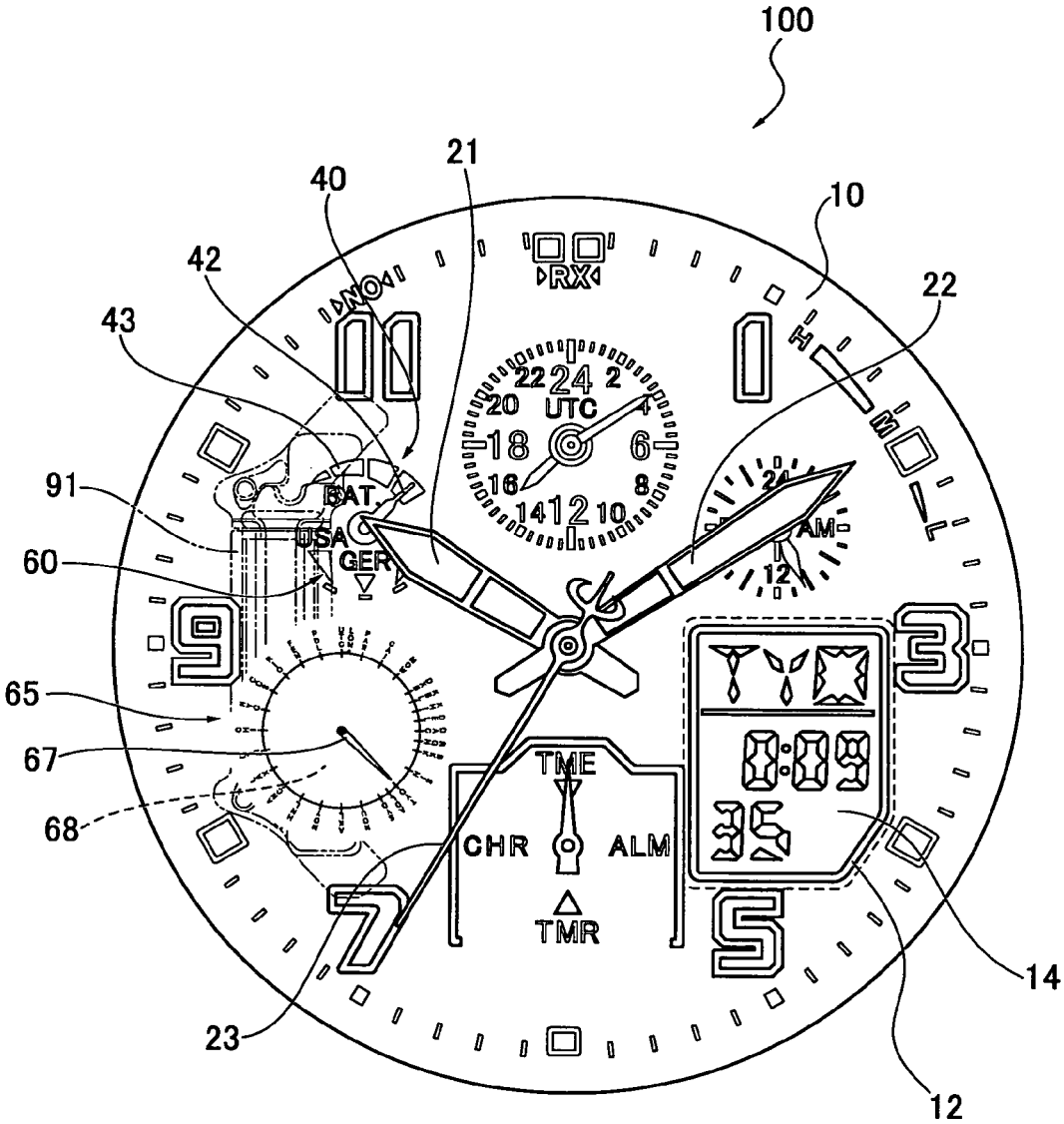
FIG. 11 shows a modified example in which a home city is analog-indicated by a pointer of a region indicator driven with a region indicator drive motor.

The radio-controlled timepiece 100 according to the embodiment shown in FIGS. 1, 5, 7, 10 is configured to digitally display the home city on the LCD 13 and use the fourth motor 84 as one with the lowest drive frequency during the reception of the standard radio wave by the antenna 91. However, the radio-controlled timepiece according to the present invention is not limited to such a configuration. For example, it can be configured to analog-indicate the home city by a pointer 67 as the charge amount indicator 40 in replace of the digital display on the LCD 13, as shown in FIG. 11.

This analog indication includes a region indicator 65 and a region indicator drive motor 68. The region indicator 65 indicates, with a pointer 67 (analog indicator), a mark (LON, PAR, TYO or else) of a single city name selected from plural regions (including city names) in different time zones from each other. The region indicator drive motor 68 (having a coaxial rotary shaft (rotor) with that of rotary center C of the pointer 67) drives the pointer 67 of the region indicator 65. The region indicator drive motor 68 rotates the pointer 67 (or plate or the like) and is disposed closer to the antenna 91 than the fourth motor 84.

Figure 12:
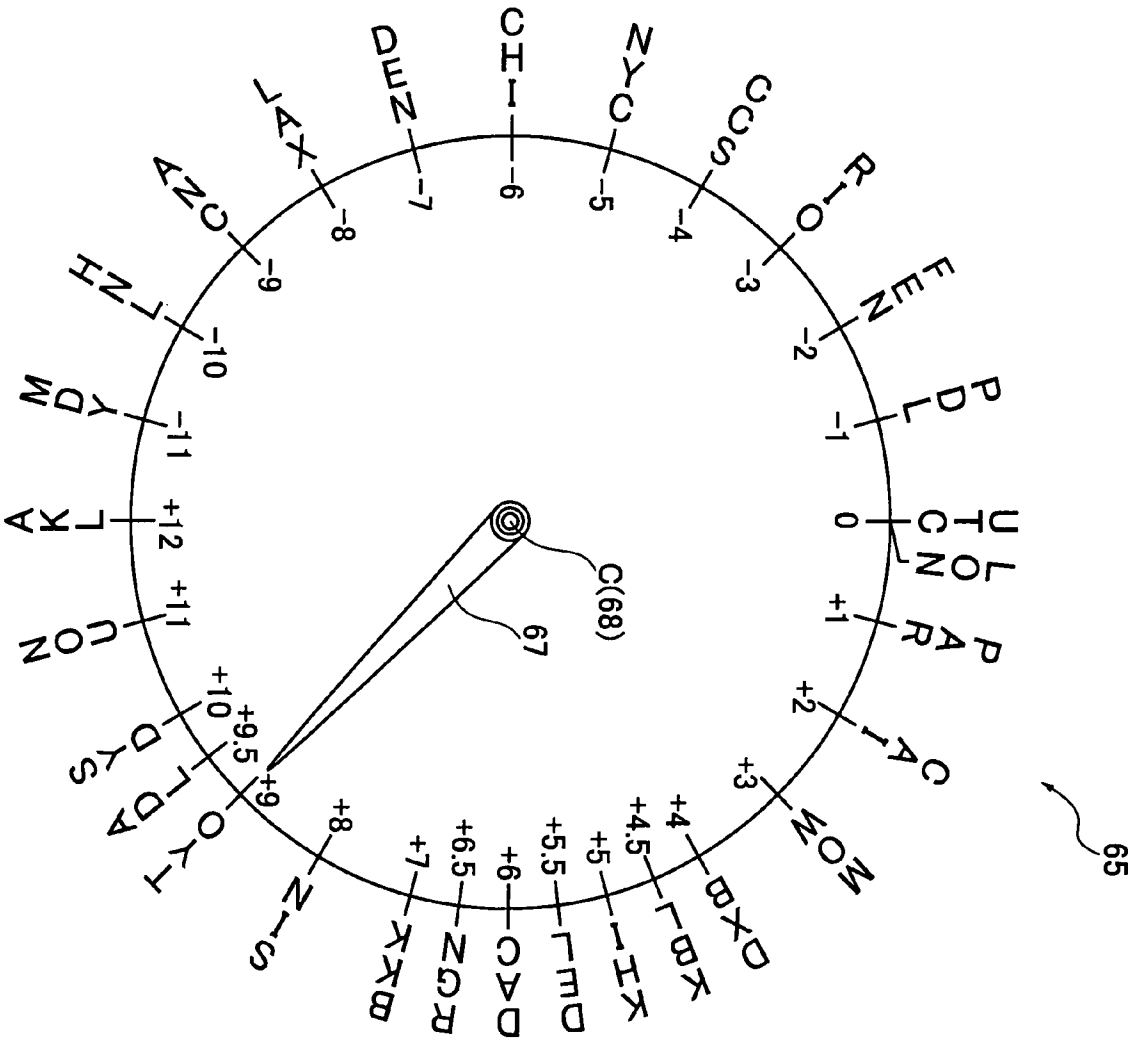
FIG. 12 is an enlarged view of details of the region indicator.

FIG. 12 is an enlarged view of the region indicator 65.

According to the thus-configured radio-controlled timepiece of the modified example 2, a city name (region) is selected as a home city by a user's manipulation to move the pointer 67. Therefore, there is no possibility that the region indicator drive motor 68 is driven or it generates noise signals during the standard radio wave reception of the antenna 91, unless the user manipulates to move the pointer 67. The drive frequency thereof is lower than that of the fourth motor 84 driving the charge amount indicator 40.

Accordingly, there is almost no possibility that the region indicator drive motor 68 is driven during the standard radio wave reception of the antenna 91, and it is able to almost completely prevent the region indicator drive motor 68 from generating the noise signal.

Unlike the LCD 13 as the digital display means, the region indicator drive motor 68 driving the pointer 67 generates almost no noise signal while maintaining a certain position of the pointer 67 because the drive signal therefor does not vary unless the position is changed. Whereas the LCD 13 needs to continuously generate the drive signal at a predetermined frequency to maintain the display irrespective of change/no change in a place to be displayed.

Thus, the analog type indication by the pointer 67 and the region indicator drive motor 68 is more advantageous in reducing the frequency where the noise signal occurs than the digital type display on the LCD 13, which can further prevent the antenna 91 from receiving the noise signal.

As shown in FIG. 12, the region indicator 65 indicates a plurality of regions which are arranged in the order of magnitude of time differences (numerals shown inside city names, "0, +1, +2 . . . +11, +12, −11, −10 . . . , −2, −1) or clockwise from the east to the west of the globe. In this manner, a user can intuitively recognize a relation of the arrangement order and the city name (can be country name, city name, region name).

Figure 13:
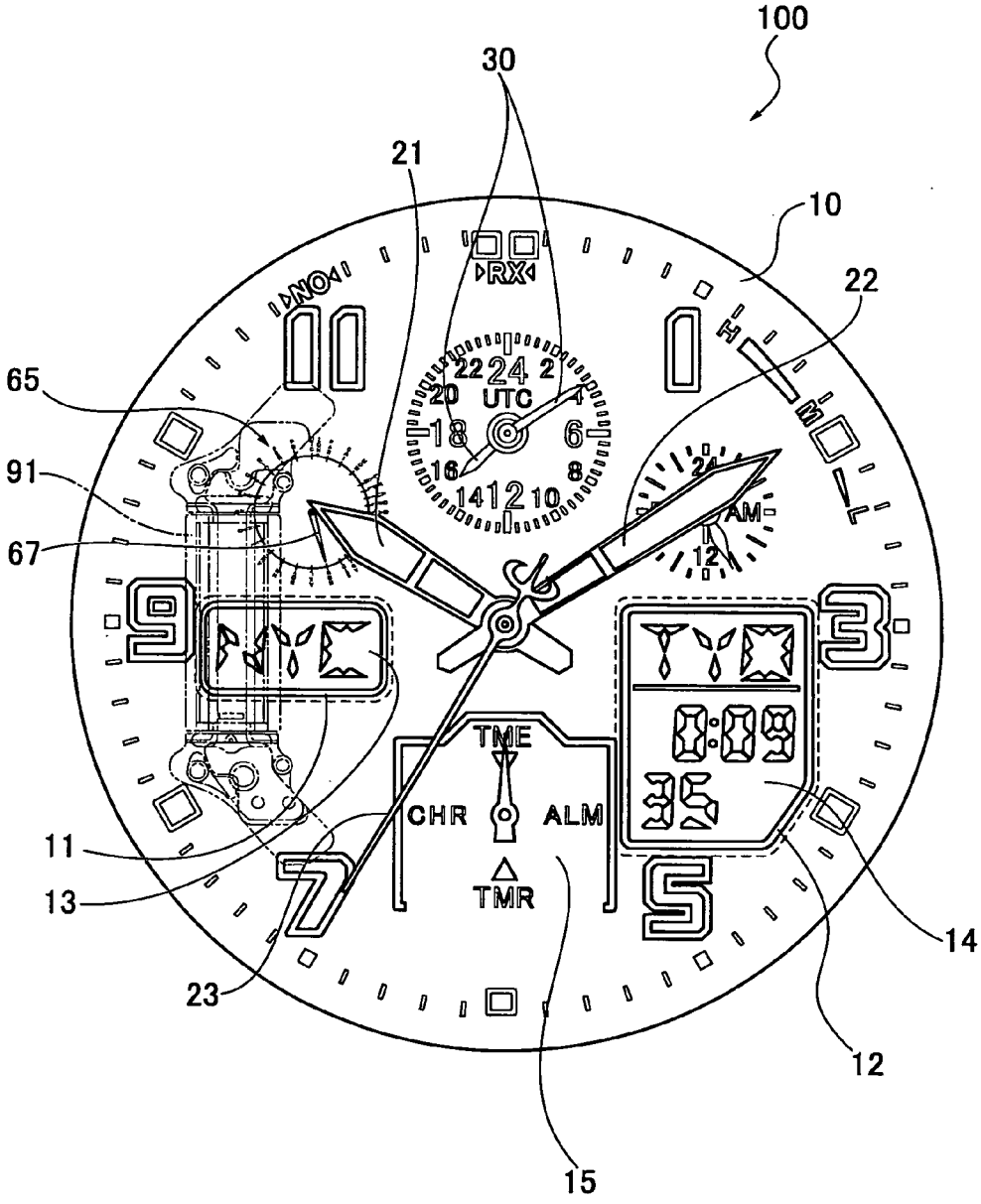
FIG. 13 is a plain transparent view of the radio-controlled timepiece in FIG. 1 including the region indicator which analog-indicates a city name or a region name by a pointer instead of the charge amount indicator.

Moreover, as shown in FIG. 13, the radio-controlled timepiece according to the present invention can be configured to include the region indicator 65 of the cities or regions with the pointer 67 at the same position as that of the charge amount indicator 40 and the originating station indicator 60 in replace of them, while maintaining the LCD 13 (displaying not only home city names but also any letters, codes, pictures or the like representing various other information) at the position shown in FIG. 1 and others. Thus configured radio-controlled timepiece can also achieve the same functions and effects as those of the embodiment in FIG. 1 and others, the modified example 1 in FIG. 10, and the modified example 2 in FIG. 11.

The invention claimed is:

1. A radio-controlled timepiece, comprising:

an antenna configured to receive a standard radio wave;

a plurality of motors configured to drive indicator portions which indicate information;

an originating station indicator configured to indicate, with an analog pointer, a mark in association with one originating station selected from a plurality of originating stations which transmit, to different regions from each other, standard radio waves including pieces of time information different from each other; and an originating station indicator drive motor for driving the originating station indicator;

wherein, among the plurality of motors, the originating station indicator drive motor is driven at a lowest frequency while the antenna is receiving the standard radio wave, and is disposed at a position closer to the antenna than the other motors.

2. A radio-controlled timepiece according to claim 1, further comprising:

a remaining amount detector configured to detect a remaining amount of a drive battery;

a remaining amount indicator configured to indicate, with an analog pointer, the remaining amount detected by the remaining amount detector; and a remaining amount indicator drive motor configured to drive the remaining amount indicator.

3. A radio-controlled timepiece according to claim 2, wherein the remaining amount indicator drive motor and the originating station indicator drive motor are the same motor; and indication of the remaining amount by the remaining amount indicator and indication of the originating station by the originating station indicator are alternatively switched.

4. A radio-controlled timepiece according to claim 3, further comprising:

a date indicator configured to indicate a date;

an indicator wheel driven by the same motor constituting the remaining amount indicator drive motor and the originating station indicator drive motor; and an indicator wheel train by the same motor constituting the remaining amount indicator drive motor and the originating station indicator drive motor so as to drive the date indicator.

5. A radio-controlled timepiece according to claim 1, further comprising:

a region indicator configured to indicate, with an analog indicator, a mark in association with one region selected from a plurality of regions with time differences from each other; and a region indicator drive motor configured to drive the region indicator, wherein the region indicator drive motor and the originating station indicator drive motor are the same motor; and indication of the region by the region indicator and indication of the originating station by the originating station indicator are alternatively switched.

6. A radio-controlled timepiece according to claim 5, wherein a plurality of regions indicated by the region indicator are arranged in order of magnitude of the time differences.

7. A radio-controlled timepiece according to claim 1, wherein the plurality of motors are disposed in order of magnitude of drive frequency during reception of the standard radio wave such that a motor having a higher drive frequency is located further from the antenna than any of the other motors having a lower drive frequency.

8. A radio-controlled timepiece, comprising:

an antenna configured to receive a standard radio wave;

a plurality of motors configured to drive indicator portions which indicate information;

a remaining amount detector configured to detect a remaining amount of a drive battery;

a remaining amount indicator configured to indicate, with an analog pointer, the remaining amount detected by the remaining amount detector;

a remaining amount indicator drive motor configured to drive the remaining amount indicator;

an originating station indicator configured to indicate, with an analog pointer, a mark in association with one originating station selected from a plurality of originating stations which transmit, to different regions from each other, standard radio waves including different pieces of time information from each other; and an originating station indicator drive motor configured to drive the originating station indicator;

wherein the remaining amount indicator drive motor doubles as the originating station indicator drive motor;

wherein indication of the remaining amount by the remaining amount indicator and indication of the originating station by the originating station indicator are alternatively switched; and wherein, among the plurality of motors, the remaining amount indicator drive motor is driven at a lowest frequency while the antenna is receiving the standard radio wave, and is disposed to a position closer to the antenna than the other motors.

* * * * *